US005904207A

United States Patent [19]

Rubbo et al.

[11] Patent Number: 5,904,207

[45] Date of Patent: May 18, 1999

[54] PACKER

[75] Inventors: Richard P. Rubbo; Stephen Reid, both of Aberdeen, United Kingdom

[73] Assignee: Petroleum Engineering Services Limited, Aberdeen, United Kingdom

[21] Appl. No.: 08/841,328

[22] Filed: Apr. 30, 1997

Related U.S. Application Data

[63] Continuation-in-part of application No. 08/641,598, May 1, 1996, Pat. No. 5,685,369.

[51] Int. Cl.[6] ..... E21B 33/12

[52] U.S. Cl. ..... 166/123; 166/195

[58] Field of Search ..... 166/123, 66.7, 166/120, 129, 195, 208, 217, 182

[56] References Cited

U.S. PATENT DOCUMENTS 4,307,781 12/1981 Preston, Jr. et al. ..... 166/123

5,224,540 7/1993 Streich et al. ..... 166/118

5,558,153 9/1996 Holcombe et al. ..... 166/66.7 X 5,701,954 12/1997 Kilgore et al. ..... 166/119

*Primary Examiner*—Frank Tsay

*Attorney, Agent, or Firm*—Thelen Reid & Priest, LLP

[57] ABSTRACT

An improved packer (plug/bridge plug) for us in the exploitation of subterranean oil and/or gas reserves comprises a mechanism (50,52) for anchoring the packer (5) within an oil/gas well, a mechanism (55,56,60,65) for setting the anchoring means (50,52), a sealing element (180), and a mechanism for setting the sealing element, wherein the mechanism (60,65,155) for setting the anchoring means (50,52) comprises a biasing mechanism (60,65), and means (155) for releasably retaining the biasing mechanism (60, 65) in an energized state, wherein, in use, when the releasable retaining mechanism (55, 56) are released the biasing mechanism (60,65) act on the anchoring means (50,52) so as to cause the anchoring mechanism (50,52) to move into a deployed position.

20 Claims, 4 Drawing Sheets

PACKER

This is a continuation-in-part of U.S. application Ser. No. 08/641,598, filed May 1, 1996 now U.S. Pat. No. 5,685,369.

BACKGROUND OF THE INVENTION

The present invention relates to a packer for use in the exploitation of subterranean oil and/or gas reserves, which reserves may be located off-shore.

Packers, sometimes referred to as plugs or bridge plugs, are known. Packers normally comprise a sealing (or packing) element, and may include setting and releasing mechanisms and/or anchoring slips.

Packers may be used in operations such as multiple zone completion, zone isolation and testing.

Many existing packers utilise elastomeric sealing elements which, after prolonged exposure to a down hole environment, are prone to perish with a corresponding loss of sealing efficiency. Existing packers further suffer from slippage (creep) within down-hole casing.

The present invention seeks to obviate or mitigate at least some of the aforementioned disadvantages.

SUMMARY OF THE INVENTION

According to a first aspect of the present invention there is provided a packer comprising means for anchoring the packer within an oil/gas well, means for setting the anchoring means, a sealing element, and means for setting the sealing element, wherein the means for setting the anchoring means comprises biasing means, and means for releasably retaining the biasing means in an energised state, wherein, in use, when the releasable retaining means are released the biasing means act on the anchoring means so as to cause the anchoring means to move into a deployed position.

The biasing means may be in a compressed state when in an energised state.

The packer may include a body which carries at least one flared portion on an outer surface thereof, an inner surface of the anchoring means being shaped that the anchoring means can rest on the flared portion when the anchoring means are in a non-deployed position, releasing of the biasing means causing the anchoring means to be urged against the at least one flared portion thereby causing the anchoring means to move radially outward into the deployed position.

Longitudinal movement of the anchoring means relative to the at least one flared portion therefore causes radial movement of the anchoring means.

The at least one flared portion may flare away from the body at an angle of between 5 to 30 degrees.

The releasable retaining means may comprise an explosive bolt.

The anchoring means may comprise a first and second longitudinal spaced sets of slips.

In such case the biasing means may comprise first and second helical springs, each spring acting on the corresponding set of slips, in use.

According to a second aspect of the present invention there is provided a packer comprising means for anchoring the packer within an oil/gas well, means for setting the anchoring means, a sealing element, and means for setting the sealing element, wherein the means for setting the anchoring means includes an explosive bolt.

According to a third aspect of the present invention there is provided a packer comprising means for anchoring the packer within an oil/gas well, means for setting the anchoring means, a sealing element, and means for setting the sealing element, wherein the means for setting the sealing element include at least one hydraulic chamber, means for applying hydraulic pressure to the at least one hydraulic chamber, and means moveably responsive to the applied hydraulic pressure, wherein, in use, when the moveable means respond to the applied hydraulic pressure the movement thereof causes the sealing element to move radially outward thereby forming a seal.

The packer according to any of the foregoing aspects of the present invention may be an annulus packer capable of forming a seal between two zones in an annular space between a tubing string and a casing of a well.

Alternatively, the packer according to any of the foregoing aspects of the present invention may be a tubing packer capable of forming a seal between two zones within a tubing string.

The packer according to any of the foregoing aspects of the present invention may preferably be of a non-retrievable type, although it may be envisaged that the packer may be of a retrievable type.

The sealing element of the packer according to any of the foregoing aspects of the present invention may be made substantially from metal/metal alloy.

In such instances the metal/metal alloy may, for example, be a durable corrosive resistant metal/metal alloy preferably compatible with corrosive resistant metal alloys such as chrome nickel.

BRIEF DESCRIPTION OF THE DRAWINGS

An embodiment of the present invention will now be described by way of example only with reference to the accompanying drawings which are.

DETAILED DESCRIPTION OF AN EMBODIMENT OF THE INVENTION

Figure 1A:
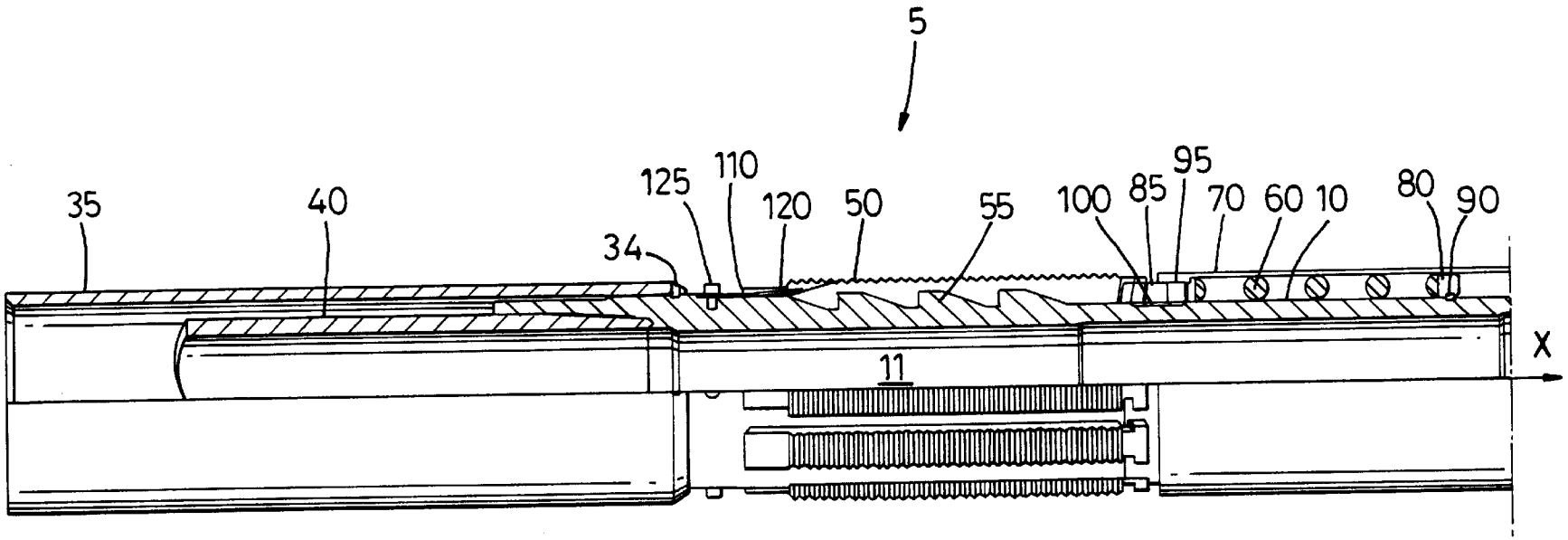
FIGS. 1(A)–1(D) a partially sectioned representation of a packer according to an embodiment of the present invention.
Figure 1B:
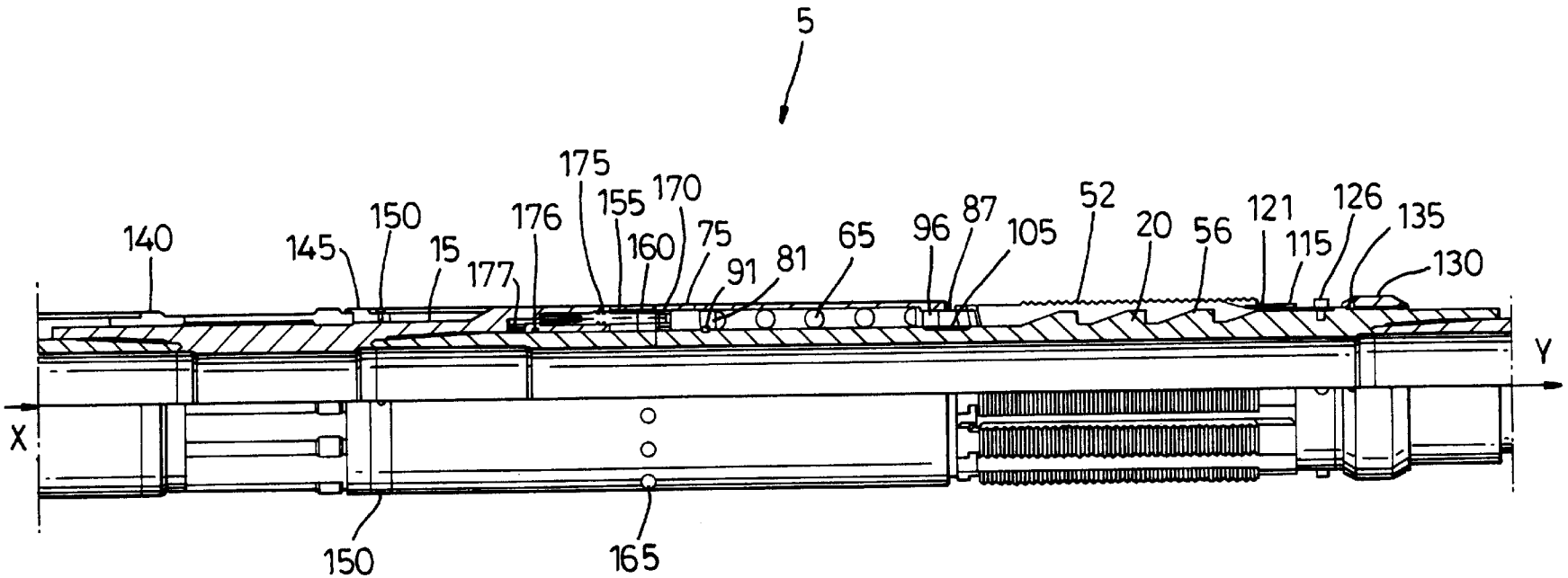
Figure 1C:
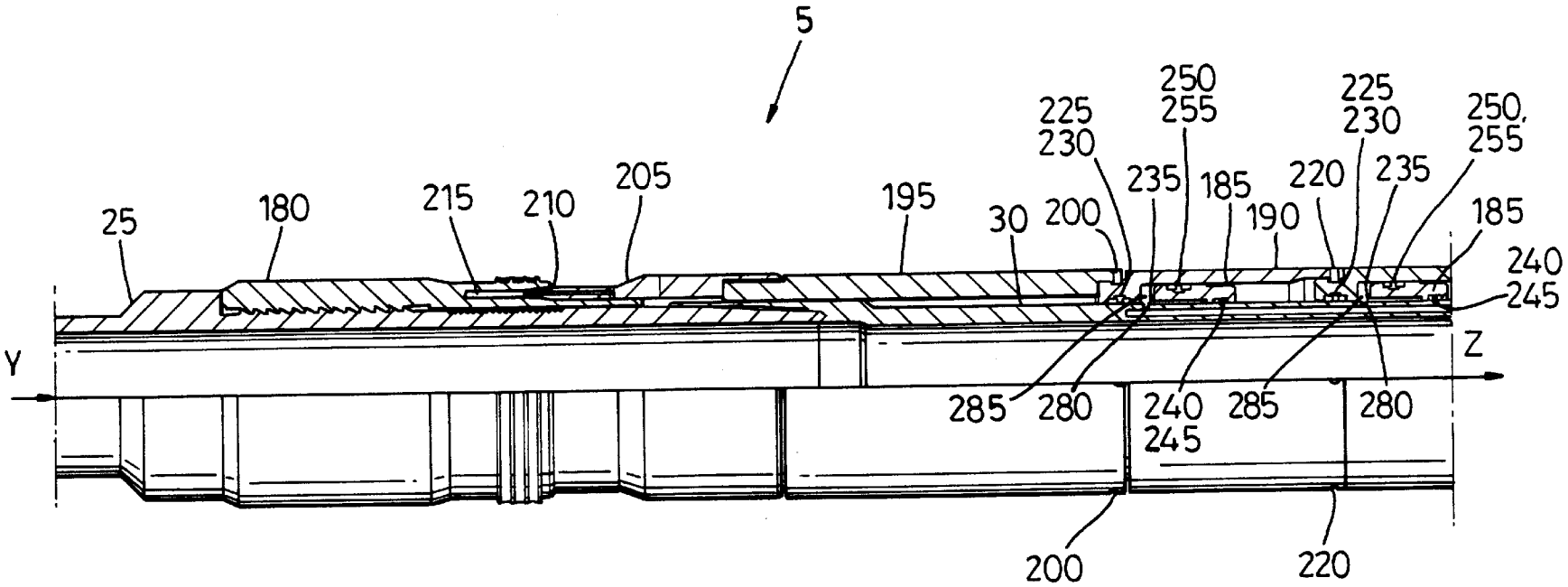
Figure 1D:
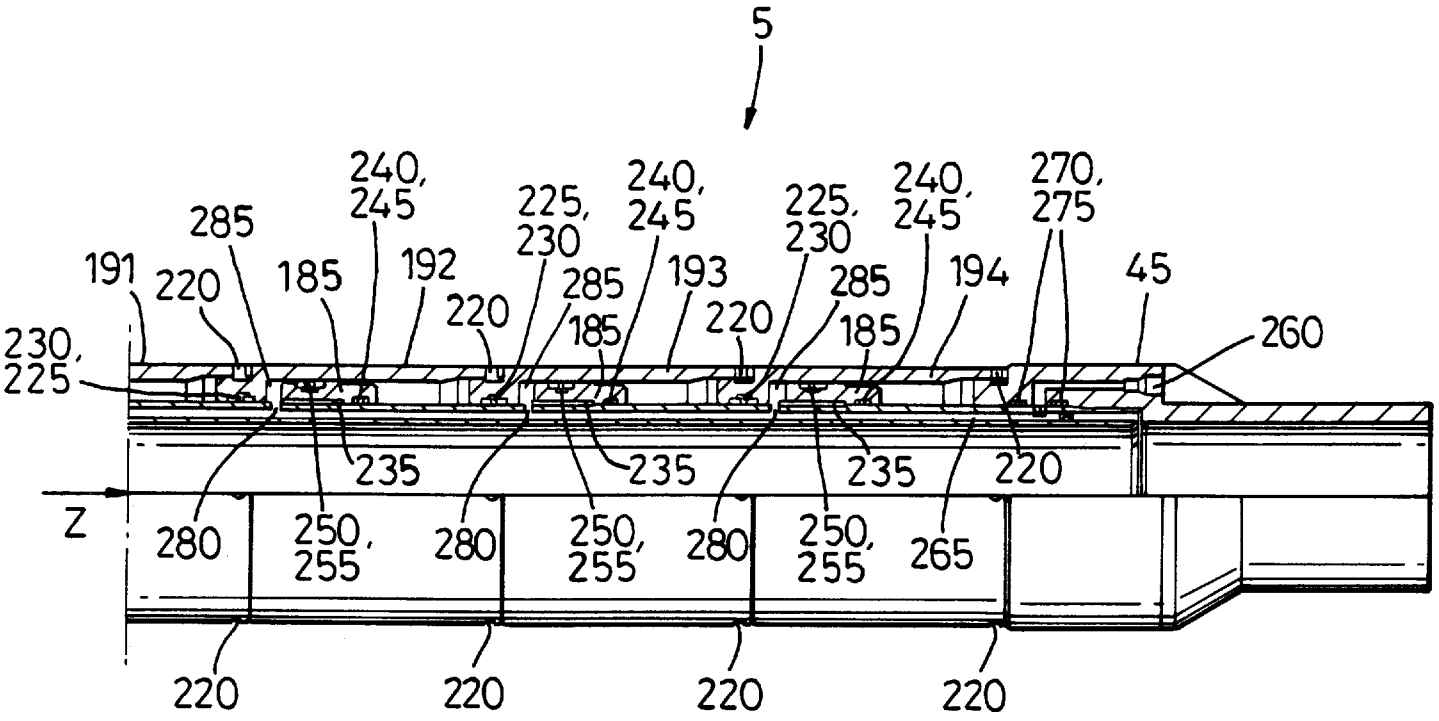

Referring to FIGS. 1(A)–(D) there is shown an packer according to an embodiment of the present invention, generally designated 5 comprising a number of bodies hereinafter identified as an upper body 10, a main body 15, a lower body 20, a seal mandrel 25 and a setting mandrel 30. Said bodies are substantially cylindrical, are provided with a central bore 11 and are connected to one another in the sequence noted above. The upper body 10 is shown in FIG. 1(A) to be connected via a lock screw 34 to a tubular guide member 35 and a portion of tubing string 40. The setting mandrel 30 is further connected to a bottom sub 45 which is connectable to a further portion of tubing string. In this way the packer 5 is integral with a length of tubing string.

The upper and lower bodies 10, 20 are each provided with a set of radially arranged slips 50, 52 which rest upon a series of tapered cones 55, 56 (flared portions) present upon respective outer surfaces of the bodies 10, 20. The inner surfaces of the individual slip members 50, 52 are fashioned such that they mirror the profiles of the taper cones 55, 56 and hence allow the slip members 50, 52 to be held close to the bodies 10, 20 when not deployed.

To enable the slips 50, 52 to be deployed there is provided a slip setting mechanism including a pair of helical springs 60, 65. The springs 60, 65 are respectively located between the outer surface of the upper and lower bodies 10, 20 and the inner surfaces of a pair of cylindrical spring housing members 70, 75 surmounting said bodies 10, 20. Each spring 60, 65 is held longitudinally between a spring washer 80, 81 and a slip retainer 85, 87. The spring washers 80 are anchored to the upper and lower bodies 10, 20 by c-rings 90, 91 while the slip retainers 85, 87 each incorporate a dog ring 95, 96 which locates in a circumferential groove 100, 105 present on the outer surface of each body 10, 20.

The uppermost end 110 of the upper slips 50 and the lowermost ends 115 of the lower slips 52 are retained against the upper and lower bodies 10, 20 respectively by a plurality of elongate spring members 120 and cap screws 125, 126. The lower body 20 is further provided with a gauge ring 130 which is attached thereto by a plurality of lock screws 135.

The upper and lower spring housing members 70, 75 are each attached to the respective upper and lower slip retainers 85, 87 and said spring housing members 70, 75 are, prior to the deployment of the slips 50, 52 connected to one another by virtue of a latch 140 and a latch retainer 145 surmounting the main body 15. The latch 140 is attached to the upper spring housing member 70 while the latch retainer 145 is secured to the lower spring housing member 75 by a plurality of screws 150.

Prior to deployment of the slips 50, 52 the springs 60, 65 are held in compression by an explosive bolt 155 retained between the main body 15 and a drive ring 160 attached to the lower spring housing member 75 by a plurality of retaining screws 165. The bolt 155 is additionally secured to the drive ring 160 by the provision of a retainer 170. Sealing between the bolt 155 and the main body 15 is achieved by virtue of a pair of O-rings 175.

Sealing between the main body 15 and the lower body 20 is achieved by virtue of an O-ring 176. Provided between an upper facing surface of the lower body 20 and a lower facing surface of the main body 15 is a core 177.

The sealing and setting mandrels 25, 30 carry a metal seal element 180 and means to set the seal element 180. The setting mandrel 30 is surmounted by a plurality of annular pistons 185 and a plurality of piston covers 190, 191, 192, 193 and 194. In this embodiment there are five pistons 185 and five piston covers 190, 191, 192, 193 and 194.

The uppermost piston cover 190 is connected to a cylindrical connector member 195 by a plurality of set screws 200. The connector member 195 is further connected to an expander ring 205. The expander ring 205 is provided with a tapered portion 210 which, prior to deployment of the seal element 180, rests at or near an entrance to a circumferential slot 215 provided within the seal element 180.

The lowermost piston cover 194 is connected by a plurality of shear screws 220 to the bottom sub 45 and the five piston covers 190–194 are connected to one another in sequence by a plurality of shear screws 220. The piston covers 190–194 are further each provided with a T-seal 225 and a pair of back-up rings 230 at their interface with the setting mandrel 30.

The pistons 185 are each rigidly connected to the setting mandrel 30 by a respective lock ring 235. Sealing between each piston 185 and the setting mandrel 30 is achieved by a respective O-ring 240 and a respective pair of back-up rings 245. A seal between each piston 185 and its respective piston cover 190–194 is provided by a T-seal 250 and a pair of back-up rings 255.

The bottom sub 45 is provided with an aperture 260 which communicates with a longitudinal extending annular chamber 265 present within the setting mandrel 30. Seals comprising an O-ring 270 and a pair of back-up rings 275 are provided both above and below the point at which the bottom sub aperture 260 connects to the setting mandrel annular chamber 265.

A plurality of ports 280 are provided in the outer wall of said annular chamber 265, said ports 280 serving to connect said annular chamber 265 with piston chambers 285 defined between an upper face of each piston 185, an inner surface of each respective piston cover 190–194 and the setting mandrel 30. The number of piston chambers 285 corresponds to the number of pistons 185. Thus in this embodiment there are five piston chambers 285.

In use, the packer 5 according to this embodiment is run on a tubing string 40 into a casing of a subterranean well (not shown). Once the packer 5 is at a required depth the upper and lower slips 50, 52 are deployed to set the packer 5 within the casing by causing the slip 50, 52 to come into contact with an inner surface of the casing.

Slip 50, 52 deployment is initiated with the triggering of the explosive bolt 155 by a flux generator (not shown) run into the central bore 11 of the packer 5, for example, on wireline. The flux generator generates on magnetic field within the packer 5 which when positioned within the area of the bolt 155 is sensed by core (coil) 177 contained on the outside of the lower body 20. The effect of the magnetic field within the core is to generate a flow of current therein which connects to a firing circuit of a detonator of the explosive belt 155. Once the explosive bolt 155 has sheared, the lower spring housing member 75 is no longer connected to the main body 15 and hence the lower spring 65 is free to expand and act against the lower slip retainer 87. The expansion of the lower spring 65 results in a downward movement of the lower spring housing member 75 which in turn causes the latch retainer 145 to disengage from the latch 140 and allows the upper spring 60 to expand and act against the upper slip retainer 85.

The action of the upper and lower springs 60, 65 respectively against the upper and lower slip retainers 85, 87 forces the slips 50, 52 onto the upper and lower mandrel tapered cones 55, 56. Hence the slips 50, 52 are deployed radially outwards until they come into contact with the casing under the biasing influence of springs 60, 65 respectively.

Once the slips 50,52 have been deployed and the packer 5 is held within the casing, the seal element 180 is deployed hydraulically. The necessary hydraulic pressure may be provided in a number of ways including placing a temporary plug in the tubing string below the packer 5 and applying the required pressure directly, or by using a wireline setting tool capable of independently generating the required pressure locally and positioning it between upper and lower seals such that the setting tool's hydraulic output acts upon a seal setting mechanism.

Irrespective of the method used to provide the necessary conditions to set the seal member 180, pressurised fluid enters the bottom sub aperture 260 and passes to the setting mandrel annular chamber 265. The fluid then passes into the piston chambers 285 and causes each piston covers 190–194 to advance up the setting mandrel 30. The movement of the piston covers 190–194 shears the shear screws 220 and further causes the connector member 195 and expander ring 205 to advance up the sealing mandrel 30. The tapered portion 210 of the expander ring 205 is thus forced into the seal element circumferential slot 215, thereby causing the seal element 180 to expand radially outwards and seal the space between the casing and the packer 5.

The embodiment of the present invention hereinbefore described is given by way of example only, and is not meant to limit the scope of the invention in any way. Modification of the disclosed embodiments would be apparent to a person skilled in the art without departing from the invention.

At least some embodiments of the packer according to the present invention provide at least some of the following advantageous attributes:

A. Sequencing—The casing anchoring slips 50, 52 can be activated and thus tubing movement effectively prevented prior to energising the metal seal 180.

B. Pressure activation—The slips 50, 52 are activated independently of applied differential setting pressures allowing the tubing to be landed in any desired axial load state; thus tubing stresses can be optimised.

C. Tubing movement is not required which allows setting against solid shoulders such as liner hangers. Since the packer 5 disclosed is not retrievable tubing workover is achieved by either torquing out the left hand connection at the top of the packer 5 or more practically, by cutting the tubing directly above this location. This no tubing movement setting feature allows a second packer to be stung into the upper receptacle of the first packer, providing string continuity for wireline operations.

D. Tubing induced loads are transmitted from the packer 5 through the slips into the casing with-out transferring through any components related to the metal sealing element, or the hydraulic setting components.

E. The multi-cones slips employed are believed to produce a uniform casing stress distribution over the slip length.

F. Integration of the cones with the mandrel achieves the rated combination load capacity within the geometric constraints presented by the desired casing and tubing strings.

G. Since the maximum applied loads are greater than the setting loads incremental slip penetration and tubing movement can not be eliminated. The seal 180 is expected to be tolerant of the resulting movement within the casing. However, springs 60, 65 minimise this effect by inducing the slips 50, 52 to take up this movement when it occurs so that it is not repeated on subsequent load cycles.

H. Tubing manipulation may be employed, depending on the completion arrangement, following activation of the slips 50, 52 and prior to seal activation in order to further minimise the one time dynamic effects on the metal seal 180.

I. The hydraulics for actuation are carried within the packer 5. Pressure can be directly applied against a temporary plug in the tail pipe or lower casing. This approach requires the application of relatively high setting pressure differentials on the order of 10,000 psi. Alternatively, a wireline setting tool capable independently generating the required pressure locally may be positioned within upper and lower seal bores such that the setting tool's hydraulic output acts on the packer.

J. In a modified embodiment the piston chambers 285 could be ported directly to the packer bore and thus obviate the need for the bottom sub aperture 260 and setting mandrel annular chamber 265.

The disclosed embodiment is an annulus packer, ie, a packer which forms a seal between two zones in the annulus between the (drill) tubing string and the well casing. However, it should be appreciated that the invention is not limited to annulus packers. Indeed tubing packers, ie, packers which form a seal between two zones within the tubing, are within the scope of the invention. The invention is, however, particularly advantageous to annulus packers.

Finally it should be understood that herein the terms lower/lowermost/upper/uppermost are used for ease of description and are intended to indicate a preferred orientation of the packer 5 within a well-bore. This is, however, only a preferred orientation and the packer 5 may be employed in a contrary orientation if so desired.

We claim:

1. A packer comprising:

anchoring means for anchoring the packer within an oil/gas well;

first setting means for setting the anchoring means, the first setting means including means for biasing the anchoring means and releasable retaining means for releasably retaining the biasing means in an energised state;

sealing means for sealing the packer in the oil/gas well; and second setting means for setting the sealing means;

wherein in use, when the releasable retaining means are released, the biasing means act on the anchoring means so as to cause the anchoring means to move into a deployed position.

2. A packer as claimed in claim 1, wherein the biasing means is in a compressed state when in an energised state.

3. A packer as claimed in claim 2, wherein the packer includes a body which carries at least one flared portion on an outer surface thereof, an inner surface of the anchoring means being shaped that the anchoring means can rest on the flared portion when the anchoring means are in a non-deployed position, releasing of the biasing means causing the anchoring means to be urged against the at least one flared portion thereby causing the anchoring means to move radially outward into the deployed position.

4. A packer as claimed in claim 1, wherein the packer includes a body which carries at least one flared portion on an outer surface thereof, an inner surface of the anchoring means being shaped that the anchoring means can rest on the flared portion when the anchoring means are in a non-deployed position, releasing of the biasing means causing the anchoring means to be urged against the at least one flared portion thereby causing the anchoring means to move radially outward into the deployed position.

5. A packer as claimed in claim 4, wherein longitudinal movement of the anchoring means relative to the at least one flared portion causes radial movement of the anchoring means.

6. A packer as claimed in claim 5, wherein the at least one flared portion flares away from the body at an angle of between 5 to 30 degrees.

7. A packer as claimed in claim 4, wherein the at least one flared portion flares away from the body at an angle of between 5 to 30 degrees.

8. A packer as claimed in claim 1, wherein the releasable retaining means comprises an explosive bolt.

9. A packer as claimed in claim 1, wherein the anchoring means comprises first and second longitudinal spaced sets of slips.

10. A packer as claimed in claim 9, wherein the biasing means comprises first and second helical springs, each spring acting on the corresponding set of slips, in use.

11. A packer as claimed in claim 1, wherein the packer is an annulus packer capable of forming a seal between two zones in an annular space between a tubing string and a casing of a well.

12. A packer as claimed in claim 1, wherein the packer is a tubing packer capable of forming a seal between two zones within a tubing string.

13. A packer as claimed in claim 1, wherein the packer is a non-retrievable type.

14. A packer as claimed in claim 1, wherein the packer is a retrievable type.

15. A packer as claimed in claim 1, wherein the sealing element is made substantially from metal/metal alloy.

16. A packer as calimed in claim 15, wherein the metal/metal alloy is a durable corrosive resistant metal/metal alloy.

17. A packer as claimed in claim 16, wherein the metal/metal alloy is compatible with corrosive resistant metal allows such as chrome nickel.

18. A packer as claimed in claim 15, wherein the metal/metal alloy is compatible with corrosive resistant metal alloys such as chrome nickel.

19. A packer comprising:

anchoring means for anchoring the packer within an oil/gas well;

first setting means for setting the anchoring means, the first setting means including an explosive bolt;

sealing means for sealing the packer in the oil/gas well; and second setting means for setting the sealing means.

20. A packer comprising:

anchoring means for anchoring the packer within an oil/gas well;

first setting means for setting the anchoring means;

sealing means for sealing the packer in the oil/gas well; and second setting means for setting the sealing means, the second setting means including at least one hydraulic chamber, hydraulic pressure-applying means for applying hydraulic pressure to the at least one hydraulic chamber, and moveably responsive means for moveably responding to the applied hydraulic pressure;

wherein in use, when the moveably responsive means respond to the applied hydraulic pressure, the movement thereof causes the sealing means to move radially outward, thereby forming a seal.

* * * * *